US007238035B2

(12) United States Patent
Silver

(10) Patent No.: US 7,238,035 B2
(45) Date of Patent: Jul. 3, 2007

(54) NORMAL-THROUGH JACK WITH MONITOR AND TEST PORTS

(75) Inventor: Charles Kevin Silver, Oradell, NJ (US)

(73) Assignee: Trompeter Electronics, Inc., Mesa, AZ (US)

( * ) Notice: Subject to any disclaimer, the term of this patent is extended or adjusted under 35 U.S.C. 154(b) by 157 days.

(21) Appl. No.: 11/151,200

(22) Filed: Jun. 14, 2005

(65) Prior Publication Data

US 2007/0010117 A1 Jan. 11, 2007

(51) Int. Cl.
*H01R 29/00* (2006.01)

(52) U.S. Cl. ..... 439/188; 439/944; 439/668

(58) Field of Classification Search ..... 439/188, 439/944, 668, 669
See application file for complete search history.

(56) References Cited

U.S. PATENT DOCUMENTS

| | | | |
|---|---|---|---|
| 3,109,997 | A | 11/1963 | Giger et al. |
| 4,749,968 | A | 6/1988 | Burroughs |
| 4,815,104 | A | 3/1989 | Williams et al. |
| 4,840,568 | A | 6/1989 | Burroughs et al. |
| 5,147,992 | A | 9/1992 | Eriksen et al. |
| 5,233,501 | A | 8/1993 | Allen et al. |
| 5,246,378 | A | 9/1993 | Seiceanu |
| 5,273,448 | A | 12/1993 | Myer et al. |
| 5,280,254 | A | 1/1994 | Hunter et al. |
| 5,295,846 | A | 3/1994 | Sumida et al. |
| 5,348,491 | A | 9/1994 | Louwagie et al. |
| 5,352,128 | A | 10/1994 | Bricaud |
| 5,382,173 | A | 1/1995 | Brown et al. |
| 5,413,494 | A | 5/1995 | Dewey et al. |
| 5,467,062 | A | 11/1995 | Burroughs |
| 5,482,469 | A | 1/1996 | Seiceanu et al. |
| 5,505,631 | A | 4/1996 | Schauer et al. |
| 5,518,414 | A | 5/1996 | Antonini et al. |
| 5,577,924 | A | 11/1996 | Louwagie |
| 5,594,347 | A | 1/1997 | Louwagie et al. |
| 5,702,262 | A | 12/1997 | Brown et al. |
| 5,885,096 | A | 3/1999 | Ogren |
| 5,913,701 | A | 6/1999 | Olson et al. |
| 5,964,607 | A | 10/1999 | Finke et al. |
| 6,045,378 | A | 4/2000 | Follingstad |

(Continued)

OTHER PUBLICATIONS

Trompeter Electronics Inc., Coax •Twinax •Triax Patching •Cable Assemblies •Connectors, Product Catalog, 1986, pp. 1-2 and 16, Thousand Oaks, CA.

*Primary Examiner*—X. Chung-Trans
(74) *Attorney, Agent, or Firm*—Sterne, Kessler, Goldstein & Fox P.L.L.C.

(57) ABSTRACT

A normal-through jack that includes a housing, wherein a first and second coaxial conductor and a switch are enclosed within the housing. The housing includes a front portion and a back portion. The front portion has a first access port and a second access port extending therefrom, and the back portion has a first coaxial cable-connector and a second coaxial cable-connector extending therefrom. The first coaxial conductor extends between the first coaxial cable-connector and a first end of a resistor, wherein a second end of the resistor is coupled with the first access port. The second coaxial conductor extends between the second access port and the second coaxial cable-connector. The switch is adapted to provide an electrical connection between the first coaxial conductor and the second coaxial conductor.

4 Claims, 3 Drawing Sheets

U.S. PATENT DOCUMENTS

| | | | | |
|---|---|---|---|---|
| 6,213,801 | B1 | 4/2001 | Tayloe et al. | |
| 6,227,889 | B1 | 5/2001 | Wu | |
| 6,328,608 | B1 | 12/2001 | Olson et al. | |
| 6,457,999 | B1 | 10/2002 | Baker et al. | |
| 6,533,616 | B2 | 3/2003 | Johnsen et al. | |
| 6,572,413 | B2 | 6/2003 | Olson et al. | |
| 6,589,062 | B1 | 7/2003 | Ogren et al. | |
| 6,676,443 | B1 | 1/2004 | Wang | |
| 6,743,032 | B2 | 6/2004 | Ogren et al. | |
| 6,761,594 | B2 | 7/2004 | Johnsen et al. | |
| 6,830,486 | B2 | 12/2004 | Norris et al. | |
| 6,830,487 | B2 | 12/2004 | Kluempke | |
| 6,848,948 | B1 | 2/2005 | Khemakhem et al. | |
| 6,872,097 | B2 | 3/2005 | Johnsen et al. | |
| 7,121,896 | B2 * | 10/2006 | Norris et al. | 439/668 |
| 2002/0081907 | A1 | 6/2002 | Olson et al. | |
| 2002/0151222 | A1 | 10/2002 | Baker et al. | |
| 2003/0022543 | A1 | 1/2003 | Ogren et al. | |
| 2003/0134541 | A1 | 7/2003 | Johnsen et al. | |
| 2003/0228781 | A1 | 12/2003 | Cooper et al. | |
| 2004/0014365 | A1 | 1/2004 | Norris et al. | |
| 2004/0014366 | A1 | 1/2004 | Kluempke | |
| 2004/0253860 | A1 | 12/2004 | Loeffelholz et al. | |

* cited by examiner

NORMAL-THROUGH JACK WITH MONITOR AND TEST PORTS

BACKGROUND OF THE INVENTION

1. Field of the Invention

The present invention is generally directed to patch jacks for use in telecommunications networks.

2. Background Art

A telecommunications network allows signals to be transmitted and/or received between various remote network elements (e.g., telephony and data). Complex connections exist between the remote network elements. These complex connections are typically routed through a number of switching centers. Examples of switching centers include a central office (as employed by a Regional Bell Operating Company (RBOC)), Competitive Local Exchange Carriers co-located with RBOC central offices, or a "telecom hotel" (which is a collection of separate facilities generally located with other telecom carriers).

The switching center will often utilize electronic and/or manual digital cross connect systems (e.g., DSX3 cross connects). For example, a digital cross connect (DSX) can be used to connect a first network element's transmission to a second network element's receiver, and the first network element's receiver to the second network element's transmission. In this way, the DSX enables communication from one network element to another in a two way communication. In other words, a DSX can be used to "cross" the transmitted signals (Tx) of a first user with the received signals (Rx) of a second user, and vice versa.

Manual rear cross connect DSX3 modules are typically mounted in large bays within the switching center. A rear portion of the DSX3 modules is connected to the telecommunications network in a complex fashion. A front portion of the DSX3 modules allows for centralized access to the complex connections of the telecommunications network—i.e., it allows signals of the telecommunications network to be tested and/or monitored. "Testing" means breaking a circuit on which the signal travels and transmitting and/or receiving a unique bit pattern. "Monitoring" means accessing the signal without breaking the circuit on which the signal travels; typically a signal is monitored through a resistor.

The front portion of a common manual rear cross connect DSX3 module includes six access ports: (i) an OUT Test port, which allows the Tx signal to be tested; (ii) a CROSS-OUT Test port, which allows the crossed Tx signal to be tested; (iii) an OUT Monitor port, which allows the Tx signal to be monitored; (iv) an IN Test port, which allows the Rx signal to be tested; (v) a CROSS-IN Test port, which allows the crossed Rx signal to be tested; and (vi) an IN Monitor port, which allows the Rx signal to be monitored.

Telecommunications networks are utilized for telephony and connection of data. Some switching centers of telecommunications networks do not cross the signals of the telecommunications networks. For example, "telecom hotels" connect remote network elements in a pass-through or normal-through fashion—i.e., without crossing the signals.

The switching centers that connect remote network elements in a normal-through fashion use DSX modules, because there are currently no other economic alternative modules that allow centralized test and monitor capabilities. However, utilizing DSX modules in a normal-through fashion makes testing and/or monitoring network signals cumbersome. In addition, much of the functionality provided by a typical six port DSX module is not utilized when the module is used in a normal-through fashion.

Therefore, what is needed is a central-access test and monitor module for use in normal-through applications.

BRIEF SUMMARY OF THE INVENTION

In accordance with an embodiment of the present invention, there is provided a central-access test and monitor module for use in normal-through applications.

An embodiment of the present invention provides a normal-through jack, including a housing. First and second coaxial conductors and a switch are enclosed within the housing. The housing includes a front portion and a back portion. The front portion has a first access port and a second access port extending therefrom, and the back portion has a first coaxial cable-connector and a second coaxial cable-connector extending therefrom. The first coaxial conductor extends between the first coaxial cable-connector and a first end of a resistor, wherein a second end of the resistor is coupled with the first access port. The second coaxial conductor extends between the second access port and the second coaxial cable-connector. The switch is adapted to provide a normally-closed electrical connection between the first coaxial conductor and the second coaxial conductor.

Two normal-through jacks used together with a faceplate form a four-port test access and monitor module for use within Tx and Rx signals. Two monitor ports and two test ports are provided at the front panel. Compared with known cross-connect modules, the test access and monitor module provides required functionality in a relatively inexpensive and easy to use form.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art(s) based on the teachings contained herein.

BRIEF DESCRIPTION OF THE DRAWINGS/FIGURES

The accompanying drawings, which are incorporated herein and form part of the specification, illustrate the present invention and, together with the description, further serve to explain the principles of the invention and to enable a person skilled in the relevant art(s) to make and use the invention.

Figure 1:
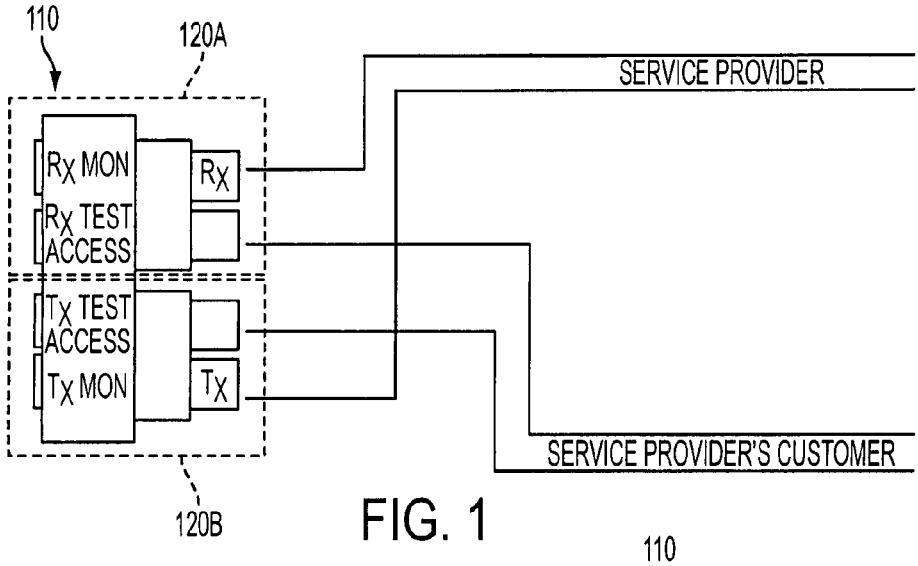
FIG. 1 depicts a portion of an example telecommunications network in which a test access and monitor module is used in accordance with an embodiment of the present invention.

The features and advantages of the present invention will become more apparent from the detailed description set forth below when taken in conjunction with the drawings, in which like reference characters identify corresponding elements throughout. In the drawings, like reference numbers generally indicate identical, functionally similar, and/or structurally similar elements. The drawing in which an element first appears is indicated by the leftmost digit(s) in the corresponding reference number.

DETAILED DESCRIPTION OF THE INVENTION

As is described in more detail herein, according to an embodiment of the present invention there is provided a central-access test and monitor module for use in normal-through applications. For example, according to an embodiment of the present invention, there is provided a 75 Ω high frequency dual coaxial normal-through module with two 20 dB front monitor access ports and two front test access ports. In addition, the central-access test and monitor module facilitates far-end loop-back testing at a front panel of a telecommunications network bay. For example, as described in more detail herein, loop back of a signal is provided by inserting a standard looping plug in the two front access ports.

FIG. 1 illustrates a test access and monitor module 110 connected to a portion of a telecommunications network. As is described in more detail below with reference to FIGS. 4, 5, and 6, test access and monitor module 110 includes a first normal-through jack 120A and a second normal-through jack 120B. As depicted in the example of FIG. 1, first normal-through jack 120A allows for test and monitor access of a received (Rx) signal, and second normal-through jack 120B allows for test and monitor access of a transmitted (Tx) signal.

An example manner in which test access and monitor module 110 is used as a normal-through test and monitor access device is now described. Data from a service provider can be routed through second normal-through jack 120B of test access and monitor module 110 and transmitted to a customer's network element. Data from the service provider's customer can be routed through first normal-through jack 120A of test access and monitor module 110 and received by the service provider. Monitoring the signal (not a test of the signal) can be accomplished by connecting a signal evaluating device (e.g., a DS-3 transmission test set) to an Rx Monitor Port of first normal-through jack 120A or a Tx Monitor Port of second normal-through jack 120B depending upon which side of the circuit is to be monitored. In this way, framing bits of the Rx signal (Tx signal) can be monitored without breaking a circuit on which the Rx signal (Tx signal) travels. Typically, a signal is monitored through a resistor, as described in more detail below.

The service provider can plug a signal evaluating device into an Rx Test Access port of first normal-through jack 120A or a Tx Test Access port of second normal-through jack 120B to test the Rx signal and Tx signal, respectively. As described below, inserting a plug into the Rx (Tx) Test Access port will break a circuit through which the Rx (Tx) signal travels. The service provider's signal evaluating device can then generate its own pseudo-random bit pattern. Advantageously, when test access and monitor module 110 is used in normal-through applications, the service provider can test the Rx and Tx signals by plugging a signal evaluating device into the front test access ports of test access and monitor module 110. The service provider is not required to gain access to the rear of test access and monitor module 110 to test the Rx and/or Tx signals.

In addition, as mentioned above, test access and monitor module 110 facilitates far-end loop-back testing at a front panel of a telecommunications network bay. If a service provider using test access and monitor module 110 is requested by a customer to provide a loop back of the signal (e.g., so the service provider's customer can do his/her own bit error rate test from his/her network element side), the service provider is only required to insert a patch cord into the Rx Test Access and Tx Test Access ports of test access and monitor module 110. In this way, a signal transmitted by the customer is directly looped back to the customer. Advantageously, by using test access and monitor module 110 in a normal-through fashion, the service provider can provide this loop-back functionality from the front of the panel, without disconnecting the two center BNC's in the rear of the panel.

Figure 2:
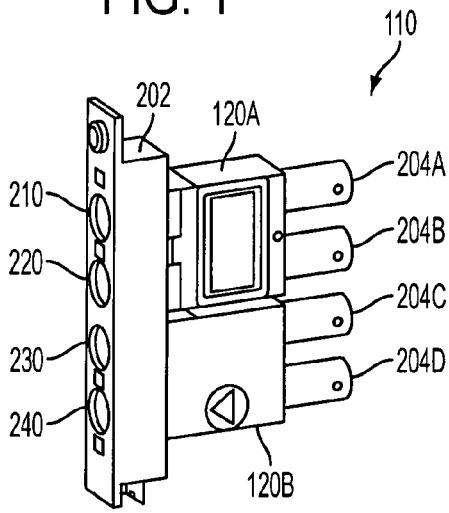
FIG. 2 depicts an example test access and monitor module in accordance with an embodiment of the present invention.

FIG. 2 shows example test access and monitor module 110 in more detail. Test access and monitor module 110 includes an elongated face plate 202, a first normal-through jack 120A, and a second normal-through jack 120B. Four access openings are axially aligned along a major axis of elongated face plate 202, defining an Rx Monitor Opening 210, an Rx Test Access Opening 220, a Tx Test Access Opening 230, and a Tx Monitor Opening 240. Front access ports of the normal-through jacks, which are described in more detail below, are aligned with the axially-aligned access openings of elongated face plate 202. In this way, test access and monitor module 110 allows test and monitor access of both Rx and Tx signals at a front panel of a telecommunications network bay. A back portion of test access and monitor module 110 includes four coaxial cable-connectors 204A–D, which allow test access and monitor module 110 to be connected to a telecommunications network.

In an example, test access and monitor module 110, when used in a normal-through mode, can perform at up to 300 MHz with a return loss of approximately −26 dB.

Figure 3:
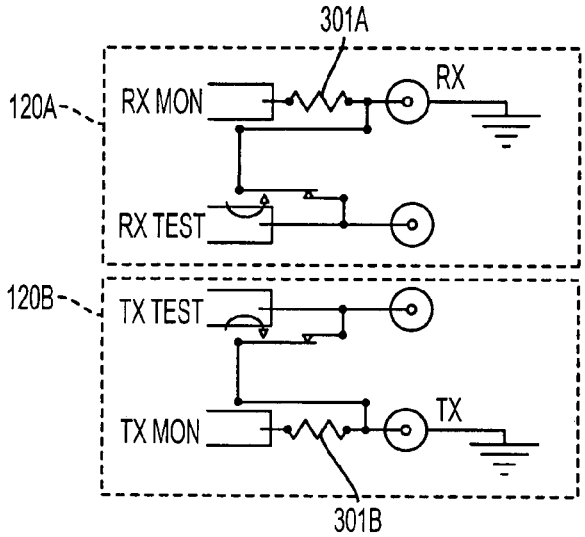
FIG. 3 illustrates a schematic electrical circuit of the test access and monitor module of FIG. 2.

FIG. 3 illustrates a schematic circuit diagram for test access and monitor module 110 in accordance with an embodiment of the present invention. As can be seen from the schematic circuit diagram, the Rx Monitor Port allows the Rx signal to be monitored through a resistor 301A without breaking the circuit through which the Rx signal travels. In a similar manner, the Tx Monitor Port allows the Tx signal to be monitored through a resistor 301B without breaking the circuit through which the Tx signal travels. In contrast, inserting a plug in the Rx Test Access Port (Tx Test Access Port) actuates a switch, thereby breaking the circuit through which the Rx (Tx) signal travels, enabling test access and monitor module 110 to be used for testing capabilities as described above.

Figure 4:
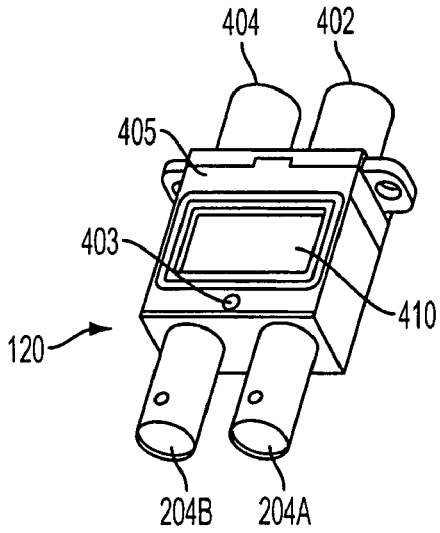
FIG. 4 is an external view of a normal-through jack included in the test access and monitor module of FIG. 2.

FIG. 4 is a perspective view of normal-through jack 120. Normal-through jack 120 includes a die-cast housing that encloses a cavity (not shown). In an example embodiment, the housing of normal-through jack 120 is made of electrodeless nickel plate; however, other types of materials can be used for the housing as would be apparent to a person skilled in the relevant art(s).

A first access port 402 and a second access port 404 extend from a front portion of the housing of normal-through jack 120. In an embodiment in which normal-through jack 120 is used in the test access and monitor module of FIG. 2, first access port 402 and second access port 404 align with first and second access openings of elongated face plate 202. In this way, first access port 402 and second access port 404, respectively, offer monitor and test access. First access port 402 and second access port 404 can be, for example, WECO patch jacks or mini-WECO patch jacks manufactured by Trompeter Electronics, Inc. of Westlake Village, Calif. However, other types of jacks can be used as would be apparent to a person skilled in the relevant art(s).

A first coaxial cable-connector 204A and a second coaxial cable-connector 204B extend from a back portion of the housing of normal-through jack 120. First coaxial cable-connector 204A and second coaxial cable-connector 204B allow normal-through jack 120 to be connected to a telecommunications network. Coaxial cable-connectors 204A and 204B can be, for example, BNC or mini-BNC connectors, also manufactured by Trompeter Electronics, Inc.

A cover 405 is used to enclose the cavity (not shown) of normal-through jack 120. Cover 405 is held in place by a drive screw 403. In addition, in the example embodiment shown in FIG. 4, a label 410 is mounted on cover 405.

Figure 5:
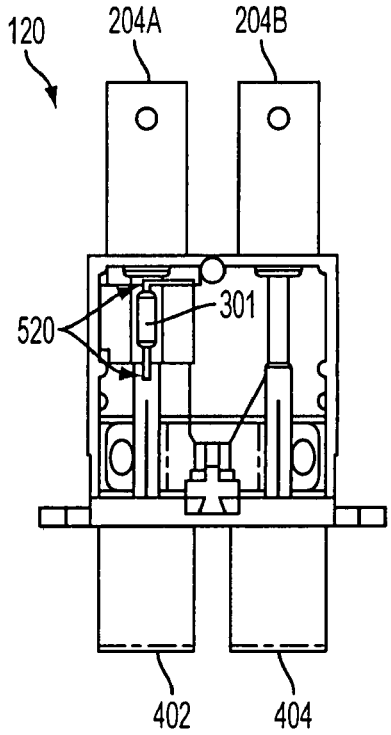
FIG. 5 is an internal view of structure within the normal-through jack of FIG. 4.
Figure 6:
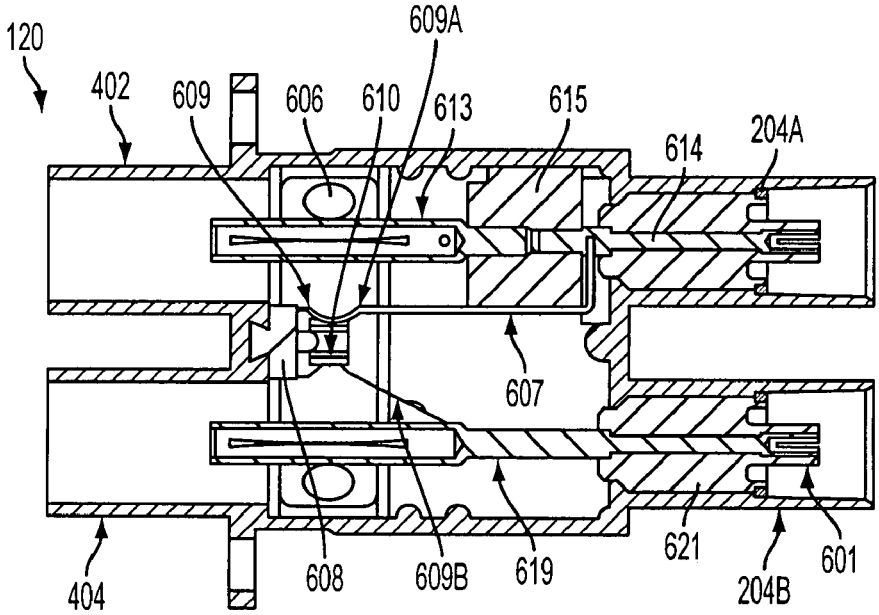
FIG. 6 is an alternate internal view of the structure within the normal-through jack of FIG. 4.

FIGS. 5 and 6 offer internal views of structure contained within the cavity of normal-through jack 120. As seen in FIG. 6, normal-through jack 120 includes (i) a first conductive path extending between first access port 402 and first coaxial cable-connector 204A, (ii) a second conductive path extending between second access port 404 and second coaxial cable-connector 204B, and (iii) a switch 609, which is normally biased to provide an electrical connection between the first and second conductive paths.

Figure 7:
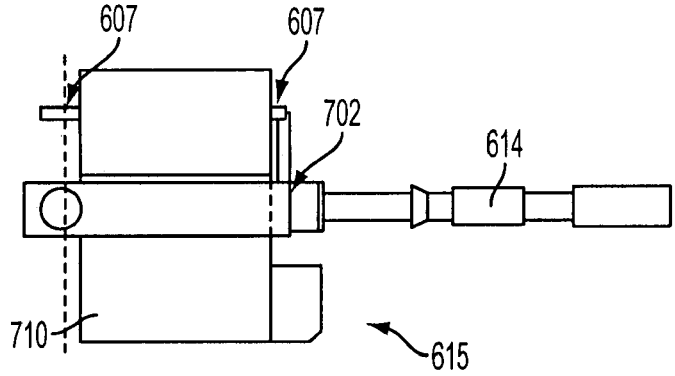
FIG. 7 illustrates a bottom view of an insert included in the normal-through jack of FIG. 4.
Figure 8:
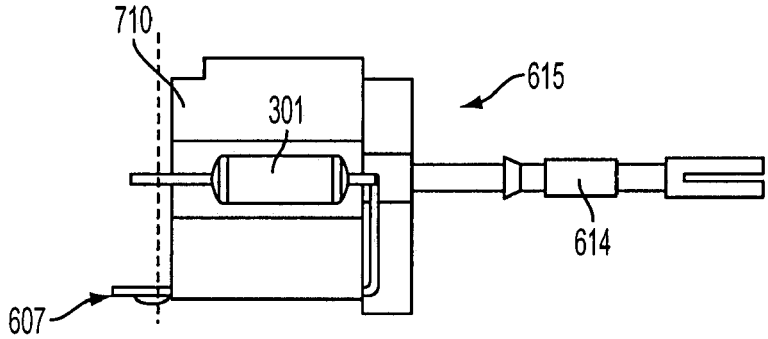
FIG. 8 illustrates a top view of the insert of FIG. 7.
Figure 9:
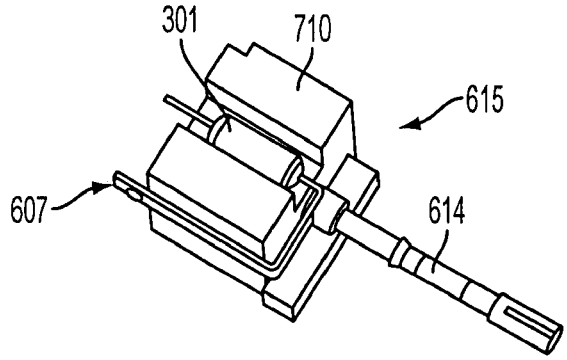
FIG. 9 illustrates a perspective view of the insert of FIG. 7.

The first conductive path includes an insert 615. FIGS. 7, 8, and 9 illustrate various views of insert 615. As can be seen from FIG. 8, insert 615 houses resistor 301. FIG. 5 illustrates that resistor 301 is connected in series between first access port 402 and first coaxial cable-connector 204A, in an analogous fashion to that depicted in the schematic circuit diagram of FIG. 3. That is, a Rx (Tx) signal can be monitored through resistor 301 in the manner described above. In an example embodiment, resistor 301 has a resistance of approximately 681 Ω.

In an example manufacturing process, insert 615 is fabricated before being installed in the cavity of normal-through jack 120. Referring to FIG. 7, insert 615 includes a contact strip 607 that partially wraps around an insulator 710. A slot 702 of a contact 614 is aligned with one end of contact strip 607 and pressed into place in insulator 710. Then, referring to FIG. 8, a first end of resistor 301 and a first end of contact strip 607 are fixed (e.g., soldered) onto contact 614. FIG. 9 shows a perspective view of a constructed insert 615, including contact 614, insulator 710, resistor 301, and contact strip 607.

In an example embodiment, contact 614 comprises gold plating, insulator 710 comprises nylon, and contact strip 607 comprises a brass alloy; however, other materials can be used as would be apparent to a person skilled in the relevant art(s). Examples of other materials that can be used for contact 614 can include, but are not limited to, brass alloy, copper, or some other electrically conductive material. Examples of other materials that can be used for insulator 710 can include, but are not limited to, glass, plastic, rubber, or some other electrical insulator. Examples of other materials that can be used for contact strip 614 can include, but are not limited to, gold, copper, or some other electrically conductive material.

Referring again to FIG. 6, after it is constructed as described above, insert 615 is disposed in the cavity of normal-through jack 120 in-line between first access port 402 and first coaxial cable-connector 204A. A second end of resistor 301 is then affixed (e.g., by a crimp, solder, or similar connection) to socket contact 613, and a second end of contact strip 607 is affixed to a first end 609A of switch 609. Contact connections 520 of FIG. 5 illustrate how resistor 301 is connected in the first conductive path.

Switch 609 of normal-through jack 120 comprises a modified wish-bone actuator having first end 609A and a second end 609B. Switch 609 is molded into a molded actuator 608 and held in place by a dielectric swage 610. Swage 610 is mounted between first end 609A and second end 609B, thereby preventing the ends from coming into contact with each other. First end 609A is the portion of switch 609 that deviates from a wish-bone actuator—i.e., as mentioned above, first end 609A is fixedly connected to contact strip 607. Second end 609B of switch 609 is similar to an end of a normal wish-bone actuator—i.e., second end 609B comprises a spring that is normally biased to be in electrical contact with a second socket contact 619 of the second conductive path. In an example embodiment, switch 609 comprises beryllium, and molded actuator 608 and dielectric swage 610 comprise Teflon.

Also included within the housing of normal-through jack 120 is a ground spring 606. When a plug is inserted in first access port 402 (or second access port 404), ground spring 606 provides a normal force to hold the plug in place. Ground spring 606 is held in place by swage 610.

The center contacts of the coaxial cable-connectors (e.g., contact 614) are held in place by an insulator 621. Insulator 621 can be made of nylon, Teflon, or some other electrical insulator as would be apparent to a person skilled in the relevant art(s).

The operation of normal-through jack 120 will now be described with reference to FIG. 6. In its normally biased position, switch 609 provides an electrical bridge between the first conductive path and the second conductive path. In particular, when used in a normal-through mode, normal-through jack 120 is connected to a telecommunications network via a first and second coaxial cable. A first plug of the first coaxial cable is inserted into coaxial cable-connector 204A and a second plug of the second coaxial cable is inserted into coaxial cable-connector 204B. A telecommunications signal from the first coaxial cable can travel from a center pin of the first plug (not shown) through contact 614. The telecommunications signal is then routed to socket contact 619 via contact strip 607 and switch 609. The signal then travels out the second coaxial cable via the connection between coaxial cable-connector 204B and the second plug.

To monitor the signal, a plug (coupled to a signal evaluating device) is inserted into first access port 402. The telecommunications signal can then be monitored through resistor 301 (not shown in FIG. 6) via socket contact 613, without interrupting the signal from being bridged to the second conductive path, as described above.

To test the signal, a plug (coupled to a signal evaluating device) is inserted into second access port 404. Inserting a plug into second access port 404 actuates switch 609, so that second end 609B is disengaged from second socket contact 619. In other words, inserting a plug into second access port 404 effectively renders second end 609B an open-circuit. Consequently, when a plug is inserted in second access port 404, there is no longer an electrical bridge between the first coaxial cable and the second coaxial cable—i.e., the circuit on which the telecommunications signal travels is broken. Since the circuit is broken, a test signal can be sent from second access port 404 directly through the second conductive path and out to the second coaxial cable via coaxial cable connector 204B.

While various embodiments of the present invention have been described above, it should be understood that they have been presented by way of example only, and not limitation. It will be understood by those skilled in the relevant art(s) that various changes in form and details may be made therein without departing from the spirit and scope of the invention as defined in the appended claims. Accordingly, the breadth and scope of the present invention should not be limited by any of the above-described exemplary embodiments, but should be defined only in accordance with the following claims and their equivalents.

It is to be appreciated that the Detailed Description section, and not the Summary and Abstract sections, is intended to be used to interpret the claims. The Summary and Abstract sections may set forth one or more but not all exemplary embodiments of the present invention as contemplated by the inventor(s), and thus, are not intended to limit the present invention and the appended claims in any way.

What is claimed is:

1. A normal-through jack, comprising:

a housing having a front portion and a back portion, the front portion having a first access port and a second access port extending therefrom, the back portion having a first coaxial cable-connector and a second coaxial cable-connector extending therefrom;

a first coaxial conductor enclosed within the housing and extending between the first coaxial cable-connector and a first end of a resistor, a second end of the resistor being coupled with the first access port;

a second coaxial conductor enclosed within the housing and extending between the second access port and the second coaxial cable-connector; and a switch enclosed within the housing and adapted to provide an electrical connection between the first coaxial conductor and the second coaxial conductor, the switch including:

(i) a first end coupled to the first coaxial conductor; and (ii) a second end in electrical contact with the second coaxial conductor when a plug is absent from the second access port, and not in electrical contact with the second coaxial conductor when a plug is inserted in the second access port.

2. The normal-through jack of claim 1, wherein the switch comprises a spring element normally biased against the second coaxial conductor.

3. A test access and monitor module, comprising:

an elongated front face-plate having four access openings aligned along a major axis of the face-plate;

first and second normal-through jacks, each normal-through jack comprising:

(a) a housing having a front portion and a back portion, the front portion having a first access port and a second access port extending therefrom, the back portion having a first coaxial cable-connector and a second coaxial cable-connector extending therefrom;

(b) a first coaxial conductor enclosed within the housing and extending between the first coaxial cable-connector and a first end of a resistor, a second end of the resistor being coupled with the first access port;

(c) a second coaxial conductor enclosed within the housing and extending between the second access port and the second coaxial cable-connector;

(d) a switch enclosed within the housing and adapted to provide an electrical connection between the first coaxial conductor and the second coaxial conductor, the switch including:

(i) a first end coupled to the first coaxial conductor; and (ii) a second end in electrical contact with the second coaxial conductor when a plug is absent from the second access port, and not in electrical contact with the second coaxial conductor when a plug is inserted in the second access port; and wherein the first and second normal-through jacks are connected to the elongated face-plate, such that the access ports of the first and second normal-through jacks are aligned with the four access openings of the elongated face-plate.

4. The test access and monitor module of claim 3, wherein the switch comprises a spring element normally biased against the second coaxial conductor.

* * * * *